US007708079B2

(12) United States Patent
McGuire et al.

(10) Patent No.: US 7,708,079 B2
(45) Date of Patent: May 4, 2010

(54) MULTI-LOCK ADAPTERS FOR INDEPENDENT SCREWED WELLHEADS AND METHODS OF USING SAME

(75) Inventors: Bob McGuire, Moore, OK (US); L. Murray Dallas, Streetman, TX (US)

(73) Assignee: Stinger Wellhead Protection, Inc., Oklahoma City, OK (US)

( * ) Notice: Subject to any disclaimer, the term of this patent is extended or adjusted under 35 U.S.C. 154(b) by 0 days.

(21) Appl. No.: 12/212,833

(22) Filed: Sep. 18, 2008

(65) Prior Publication Data

US 2009/0025925 A1 Jan. 29, 2009

Related U.S. Application Data

(60) Continuation of application No. 11/890,906, filed on Aug. 8, 2007, now Pat. No. 7,428,931, which is a continuation of application No. 11/411,384, filed on Apr. 25, 2006, now Pat. No. 7,267,180, which is a division of application No. 10/607,921, filed on Jun. 27, 2003, now Pat. No. 7,032,677.

(51) Int. Cl.
*E21B 33/03* (2006.01)

(52) U.S. Cl. ..... 166/379; 166/85.4; 166/96.1

(58) Field of Classification Search ..... 166/75.13, 166/75.14, 85.1, 90.1, 96.1, 123.3, 379, 85.4
See application file for complete search history.

(56) References Cited

U.S. PATENT DOCUMENTS

| | | | |
|---|---|---|---|
| 2,109,031 | A | 2/1938 | O'Neal |
| 3,158,389 | A | 11/1964 | Turner |
| 3,343,603 | A | 9/1967 | Miller |
| 3,675,719 | A | 7/1972 | Slator et al. |
| 4,353,420 | A | 10/1982 | Miller |
| 4,993,488 | A | 2/1991 | McLeod |
| 5,092,401 | A | 3/1992 | Heynen |
| 5,103,900 | A | 4/1992 | McLeod et al. |
| 5,605,194 | A | 2/1997 | Smith |
| 5,660,234 | A | 8/1997 | Hebert et al. |
| 6,179,053 | B1 | 1/2001 | Dallas |
| 6,196,323 | B1 | 3/2001 | Moksvold |
| 6,220,363 | B1 | 4/2001 | Dallas |
| 6,247,537 | B1 | 6/2001 | Dallas |
| 6,289,993 | B1 | 9/2001 | Dallas |
| 6,364,024 | B1 | 4/2002 | Dallas |
| 6,491,098 | B1 | 12/2002 | Dallas |
| 6,557,629 | B2 | 5/2003 | Wong et al. |
| 6,626,245 | B1 | 9/2003 | Dallas |
| 6,769,489 | B2 | 8/2004 | Dallas |
| 6,817,421 | B2 | 11/2004 | Dallas |
| 6,817,423 | B2 | 11/2004 | Dallas |
| 6,918,439 | B2 | 7/2005 | Dallas |

(Continued)

*Primary Examiner*—Hoang Dang
(74) *Attorney, Agent, or Firm*—Nelson Mullins Riley & Scarborough, LLP

(57) ABSTRACT

A multi-lock adapter used to inject high-pressure well stimulation fluids through an independent screwed wellhead includes an adapter pin having a central passageway with an internal diameter at least as large as a passageway through the wellhead. A lockdown flange secures the adapter pin to a casing mandrel of the wellhead. The lockdown flange ensures that stress on connection points to the screwed independent wellhead due to elevated fluid pressures used for well stimulation procedures does not exceed engineered specifications.

20 Claims, 11 Drawing Sheets

U.S. PATENT DOCUMENTS 6,938,696 B2 9/2005 Dallas
6,948,565 B2 9/2005 Dallas
7,032,677 B2 4/2006 McGuire et al.
7,267,180 B2 9/2007 McGuire et al.
7,428,931 B2 * 9/2008 McGuire et al. ..... 166/379

* cited by examiner

MULTI-LOCK ADAPTERS FOR INDEPENDENT SCREWED WELLHEADS AND METHODS OF USING SAME

CROSS-REFERENCE TO RELATED APPLICATIONS

This is a continuation of U.S. patent application Ser. No. 11/890,906 filed Aug. 8, 2007, now U.S. Pat. No. 7,428,931; which was a continuation of U.S. patent application Ser. No. 11/411,384 filed Apr. 25, 2006, now U.S. Pat. No. 7,267,180; which was a division of U.S. patent application Ser. No. 10/607,921, filed Jun. 27, 2003, now U.S. Pat. No. 7,032,677.

MICROFICHE APPENDIX

Not Applicable.

TECHNICAL FIELD

The present invention relates generally to wellhead assemblies and, in particular, to a lock down flange for use in independent screwed wellheads with existing casing mandrels.

BACKGROUND OF THE INVENTION

The American Petroleum Institute (API) has classified various independent screwed wellheads that are well known in the art for securing a surface casing, and for supporting various well servicing equipment. Independent screwed wellheads support independently secured heads for each tubing string supported in a well bore. Independent screwed wellheads are widely used for production from low-pressure production zones because they are economical to construct and maintain.

It is well known in the art that low pressure wells frequently require some form of stimulation to improve or sustain production. Such stimulation procedures typically involve pumping high pressure fluids down the casing in order to fracture production zones. The high pressure fluids are often laden with proppants, such as bauxite and/or sharp sand.

FIG. 1 illustrates a prior art Larkin style independent screwed wellhead apparatus. The independent screwed wellhead apparatus includes a casing mandrel 20 supported in a casing bowl 22 of a wellhead 24 by a lockdown nut 26 that threadedly engages pin threads on an exterior periphery 37 of the wellhead 24. In the Larkin-style wellhead the casing mandrel 20 extends above the lockdown nut 26. The wellhead 24 is secured to a surface casing 28 that forms an outer periphery of the well bore at the surface. The casing mandrel 20 is supported in the casing bowl 22, and snubbed by the lockdown nut 26. The casing mandrel 20 supports a production casing 30 within the wellbore. The production casing 30 is threadedly connected to the casing mandrel 20 by bottom box threads 32 that engage threads 34 on the outer periphery of the production casing 30. A full-bore axial passage 36 extends through the casing mandrel 20 concentric with the bottom box threads 32. Top box threads 38 can be used for connection of an adapter that permits connection of a well stimulation tool. A fluid seal is provided between the casing mandrel 20 and the casing bowl 22 by annular grooves 40 that retain O-ring seals.

FIG. 2 schematically illustrates a cross-sectional view of another prior art independent screwed wellhead apparatus of a known configuration that is commercially available from Wellhead Inc. of Bakersfield, Calif., USA. In FIG. 2, neither the production casing nor the adapter for the well stimulation tool is shown. Accordingly, the top 38 and bottom 32 box threads can be seen. The casing mandrel 20' has a lower profile, and therefore has a shorter axial passage 36'. The remainder of the casing mandrel 20' is substantially the same as corresponding parts of the casing mandrel 20 illustrated in FIG. 1, except that a top surface of the lockdown nut 26 is horizontally aligned with a top surface of the casing mandrel 20' shown in FIG. 2.

FIG. 3 schematically illustrates the casing mandrel 20' shown in FIG. 2, in a typical configuration used for prior art well stimulation procedures. The casing mandrel 20' is threadedly connected to the production casing 30, and to a flanged casing pin adapter 42, and is secured to the wellhead 24 using lockdown nut 26. The flanged casing pin adapter 42 is typical of those in use today, in that the sole means for coupling the pin adapter 42 to the wellhead 24 is a pin thread 44 that engages the top box threads 38 of the casing mandrel 20'.

The flanged casing pin adapter 42, includes a body that forms an axial passage 46 with a cylindrical section **46*a* and an upward widening truncated conical section 46*b*. The function of the flanged casing pin adapter 42 is to permit connection of well stimulation tools and other equipment (e.g. a high pressure valve or a blowout preventer (BOP)) to the casing mandrel 20'. Accordingly the flanged casing pin adapter 42 has a flanged top surface 48 that enables secure connection of any flanged component. An annular groove 50 accommodates a flange gasket for preventing fluid leakage across the interface between the flanged casing pin adapter 42** and the other component.

In a typical well stimulation procedure, a casing saver (not shown), such as a casing packer as described in U.S. Pat. No. 4,993,488, which issued to Macleod on Feb. 19, 1991, is inserted through a BOP and into the production casing 30. The casing saver is sealed off against the production casing 30 and high pressure fluids are injected through the casing saver into a formation of the well. While the casing saver protects the exposed top end of the production casing 30 from "wash-out", it does not relieve the top box thread 38 or the pin thread 44 from mechanical stress induced by the elevated fluid pressures generated by the injection of high pressure fracturing fluid into the well. In a typical fracturing operation, high pressure fluids are pumped into the well at around 9500 lbs per square inch (PSI). If "energized fluids" or high pumping rates at more than 50 barrels per minute are used, peak pressures can exceed 9500 PSI. In general, the threads retaining the flanged casing pin adaptor 42 in the casing mandrel 20 are engineered to withstand 7000 PSI, or less. Consequently, high pressure stimulation using standard equipment can expose the flanged casing pin adaptor 42 to an upward pressure that exceeds the strength of the bottom pin thread 44. If either the top box thread 38 or the pin thread 44 fails, the flanged casing pin adaptor 42 and any connected equipment may be ejected from the well and hydrocarbons, and stimulation fluids may be released into the atmosphere. This is potentially dangerous and an undesirable situation.

Furthermore, use of a casing saver to perform well completion or re-completion slows down operations in a multi-zone well because the flow rates are hampered by the reduced internal diameter of the casing saver. Moreover, the casing saver must be removed from the well each time the fracturing of a zone is performed, in order to permit isolation plugs or packers to be set, as it is necessary to isolate a next zone to be stimulated. It is well known in the art that the disconnection of fracturing lines and the removal of a casing saver is a time consuming operation that keeps expensive fracturing equipment and/or wireline equipment and crews sitting idle. It is therefore desirable to provide full-bore access to the well casing in order to ensure that transitions between zones in a multi-stage fracturing process are accomplished as quickly as possible.

Applicants have designed a wellhead that overcomes these problems by providing an improved casing mandrel for securing components to an independent screwed wellhead. The improved casing mandrel is described in co-pending United States Patent Application Publication No. 20040231856 entitled CASING MANDREL WITH WELL STIMULATION TOOL AND TUBING HEAD SPOOL FOR USE WITH THE CASING MANDREL, which was filed on May 19, 2003, the specification of which is incorporated herein by reference. However, the independent screwed wellheads such as the Larkin and Wellhead Inc. styles described above, which remain in wide use do not accommodate secure connection of high pressure components for reasons described above.

There therefore exists a need for adapters that provide full-bore access to a casing in a well to be stimulated, while significantly improving safety for well stimulation crews by ensuring that a hold strength of the adapter through which well stimulation fluids are injected exceeds fluid injection pressures by an adequate margin to ensure safety.

SUMMARY OF THE INVENTION

It is therefore an object of the invention to provide adapters that provide full-bore access to a casing in a well to be stimulated.

It is a further object of the invention to improve safety for well stimulation crews by ensuring that a hold strength of adapters through which well stimulation fluids are injected exceeds fluid injection pressures.

The invention therefore provides a multi-lock adapter for an independent screwed wellhead, comprising: a lockdown flange adapted to be connected to the independent screwed wellhead; an adapter pin received in an axial passageway through the lockdown flange and threadedly coupled to a top box thread of a casing mandrel supported by the independent screwed wellhead; and a connection between the lockdown flange and the adapter pin to reinforce the threaded coupling between the casing mandrel and the adapter pin.

The invention further comprises a multi-lock adapter for the injection of high pressure fracturing fluid into a well through an independent screwed wellhead, the multi-lock adapter comprising: an adapter pin having a pin threaded nipple for engaging top box threads in a central passage of a casing mandrel of the wellhead; a lockdown flange connected to the adapter pin; and a lockdown nut for securing the lockdown flange to the independent screwed wellhead to thereby lock the adapter pin to the casing mandrel.

The invention also provides a multi-lock adapter used to inject high pressure fracturing fluid into a cased well equipped with an independent screwed wellhead, the multi-lock adapter comprising: an adapter pin with a threaded nipple that engages top box threads in a central passage of a casing mandrel of the screwed independent wellhead; and a lockdown flange secured to the independent screwed wellhead by a lockdown nut and connected to the adapter pin to lock the adapter pin to the casing mandrel.

BRIEF DESCRIPTION OF THE DRAWINGS

Further features and advantages of the present invention will become apparent from the following detailed description, taken in combination with the appended drawings, in which.

It will be noted that throughout the appended drawings, like features are identified by like reference numerals.

DETAILED DESCRIPTION OF THE PREFERRED EMBODIMENT

The invention provides a lock down flange for providing a flanged connection to a casing mandrel of an independently screwed wellhead. The lock down flange may be a multi-lock adapter for connecting a well stimulation tool, a blowout preventer, or a high pressure valve to a standard casing mandrel of a prior art independent screwed wellhead that only provides box threads for coupling the stimulation tool to the casing mandrel. The multi-lock adapter ensures improved efficiency and safety while completing and/or re-completing wells. Efficiency is improved by enabling full-bore access to a casing of the well, and eliminating reliance on casing savers. Safety is improved by ensuring that stress on connection points to the wellhead during well stimulation procedures does not exceed engineered stress tolerances.

Figure 4:
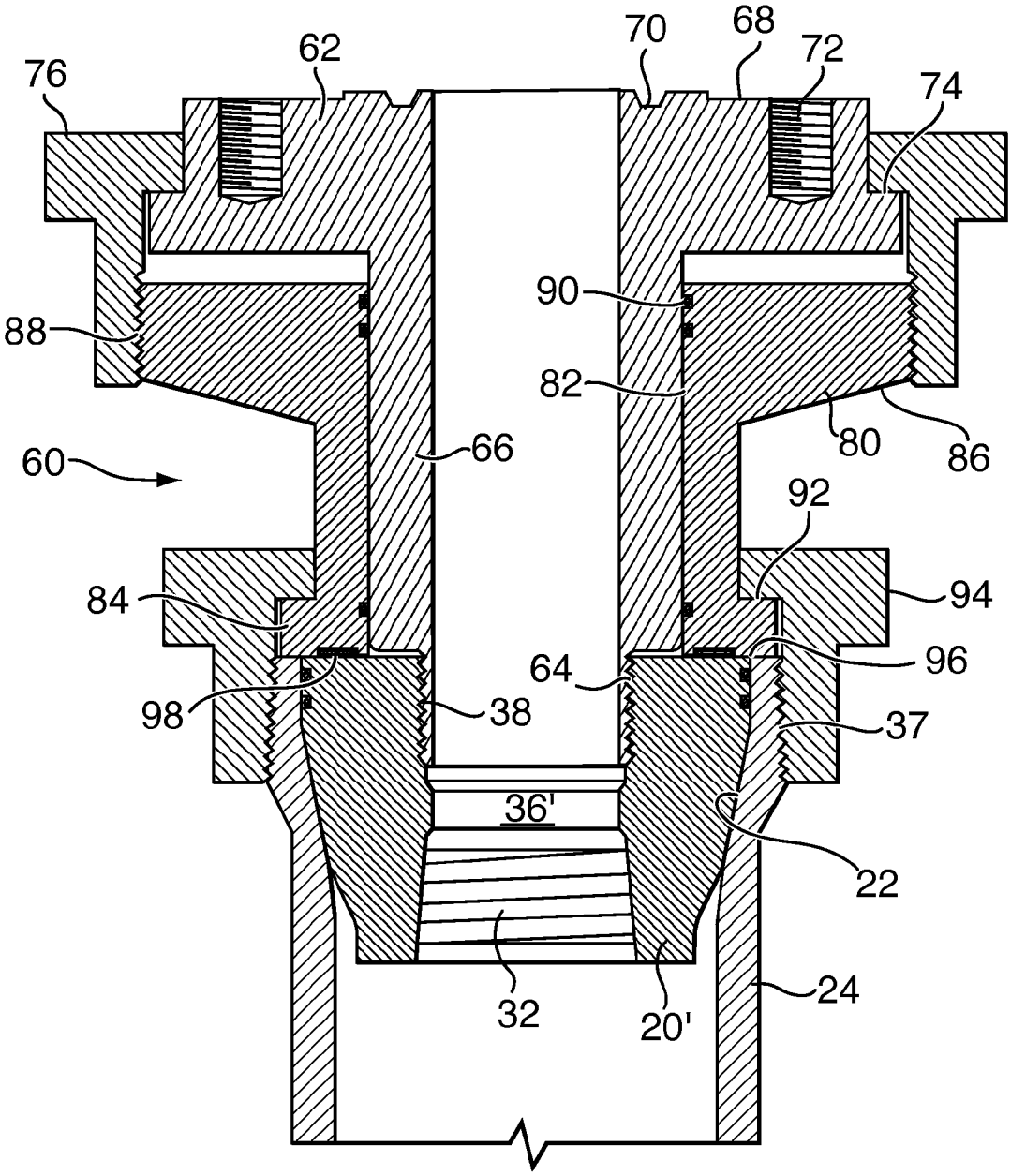
FIG. 4 is a schematic cross-sectional view of a two-piece multi-lock adapter using a first lock down flange for secure connection to the prior art independent screwed wellhead apparatus shown in FIG. 2.

FIG. 4 is a schematic cross-sectional view of a multi-lock adapter 60 in accordance with the invention, secured to an independent screwed wellhead equipped with the prior art casing mandrel 20'. The multi-lock adapter 60 includes a flanged adapter pin 62 having a pin-threaded nipple on a bottom end 64 for connection to the top box threads 38 of the casing mandrel 20', an elongated hollow mandrel 66 that provides a coaxial extension of the axial passage 36', and a top flanged end 68. The top flanged end 68 is adapted to support a high pressure valve, a blowout preventer or a well fracturing assembly, commonly referred to as a "fracstack", in a manner well known in the art. The top flanged end 68 provides an annular groove 70 for receiving a flange gasket, and a plurality of box threaded bores 72 for receiving and retaining respective flange bolts. The flanged adapter pin 62 also includes an annular shoulder 74 for supporting a top lockdown nut 76.

The elongated hollow mandrel 66 has a cylindrical outer wall that cooperates with an inner wall of a lockdown flange 80 to permit sliding and rotational movement of the lower part of the flanged adapter pin 62 within the lockdown flange 80. The lockdown flange 80, the lockdown nut 76, and the flanged adapter pin 62 together form the multi-lock adapter 60 of the present embodiment. The lockdown flange 80 has a central passage with an interior wall 82, a bottom end 84 for connection to the independent screwed wellhead 24, and a top connector end 86 with connector pin threads 88 engaged by the top lockdown nut 76. The interior wall 82 includes a plurality of grooves 90 (3 shown) for retaining elastomeric seals, such as O-ring seals, in order to prevent fluid that may leak across an interface between the casing mandrel 20' and the flanged adapter pin 62, from escaping between the outer wall of the elongated hollow mandrel 66 and the interior wall 82 of the of the lockdown flange 80.

The bottom end 84 includes a radially extending flange with a bearing shoulder 92 that cooperates with a bottom lockdown nut 94 to permit the lockdown flange 80 to be secured to the independently screwed wellhead 24. More specifically, the pin threads on the exterior periphery 37 of the wellhead 24 used to retain the casing mandrel 20', are used to secure the bottom lockdown nut 94. An annular groove 98 in a bottom surface 96 of the lockdown flange 80 retains a fluid seal that prevents leakage of fluid between the lockdown flange 80 and the casing mandrel 20'.

The multi-lock adapter 60 is installed on the casing mandrel 20' by inserting a seal in the annular groove 98, and placing the lockdown flange 80 on the independent screwed wellhead 24. The bottom lockdown nut 94 is rotated to engage the pin threads 37 on the independent screwed wellhead 24 to provide a first lock to the wellhead. Thereafter, the flanged adapter pin 62 is inserted into the lockdown flange 80, and rotated so that the pin threads on the bottom end 64 threadedly engage the top box threads 38 of the casing mandrel 20' until the flanged adapter pin 62 is securely connected to the casing mandrel 20', providing the second lock between the multi-lock adapter 60 and the independent screwed wellhead 24. The top lockdown nut 76 is then placed over the flanged adapter pin 62, and rotated into threaded engagement with the connector pin threads 88 to assemble the two parts of the multi-lock adapter 60. The lockdown flange 80 secures the flanged adapter pin 62 to the independent screwed wellhead 24 to reinforce the threaded coupling between the casing mandrel 20' and the flanged adapter pin 62.

It should be understood by those skilled in the art that the location of the top lockdown nut 76 with respect to the flanged adapter pin 62 is a matter of design choice. An embodiment showing an alternate placement of the top lockdown nut 76 is illustrated in FIG. 5.

Figure 5:
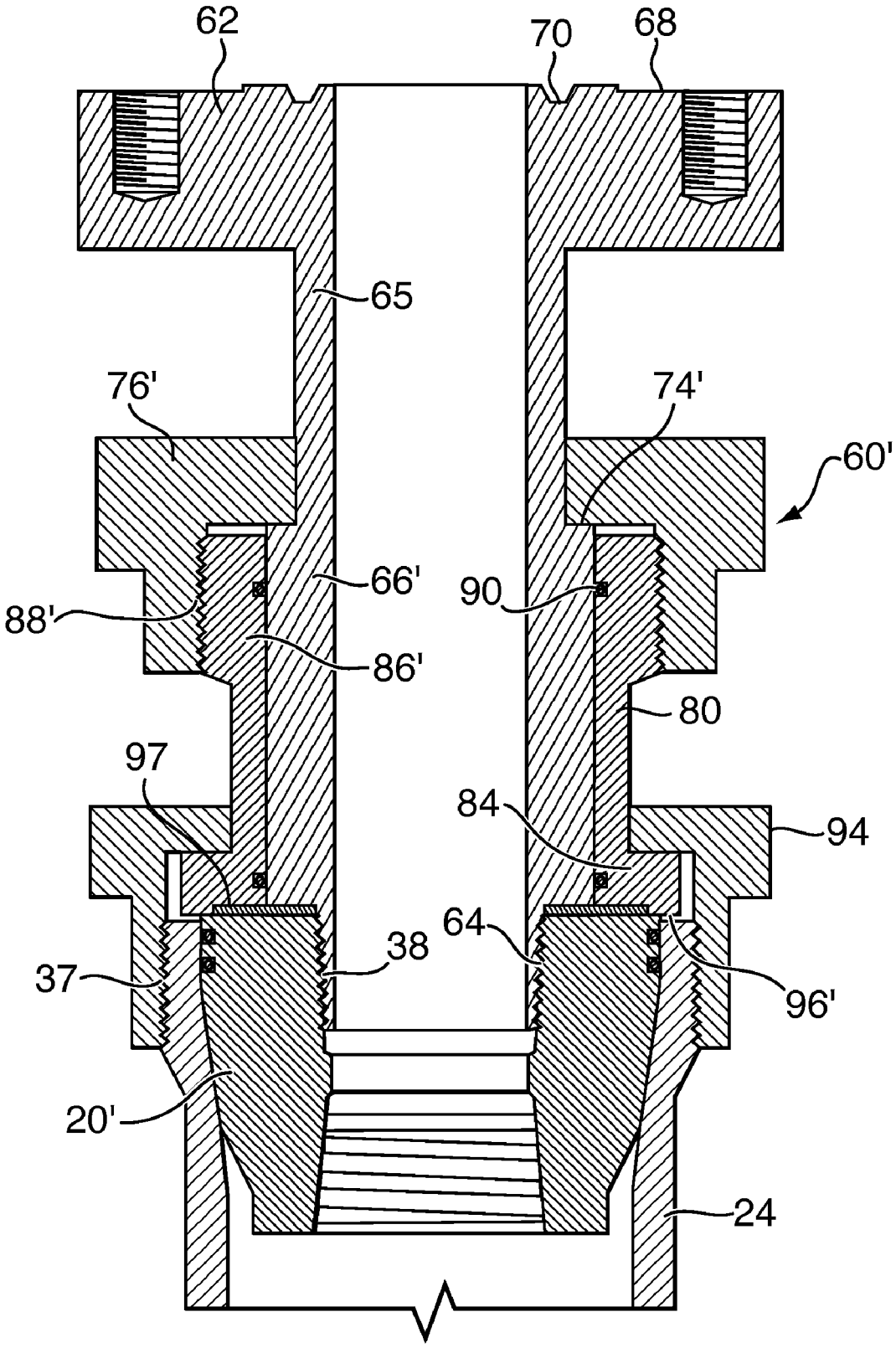
FIG. 5 is a schematic cross-sectional view of an alternate two-piece multi-lock adapter using a second embodiment of the lock down flange for secure connection to the prior art independent screwed wellhead apparatus shown in FIG. 2.

FIG. 5 is a schematic cross-sectional view of a multi-lock adapter 60' in accordance with the invention that is the same as the embodiment illustrated in FIG. 4 except that a location of the top lockdown nut 74' that secures the flanged adapter pin 62 to the lockdown flange 80 is changed. The outer wall of the elongated hollow mandrel 66' includes a section 65 of reduced diameter forming a supporting annular shoulder 74' for rotatably retaining the top lockdown nut 76'. In this embodiment, another example of a gasket for providing the fluid seal between the lockdown flange 80 and the top of the casing mandrel 20' is also shown. A pancake gasket 97 is captively held in annular grooves in the bottom surface 96' and a bottom of the elongated hollow mandrel 66'. A description of the remainder of the multi-lock adapter 60' will not be repeated here, since the other components are the same as described above with reference to FIG. 4.

Figure 6:
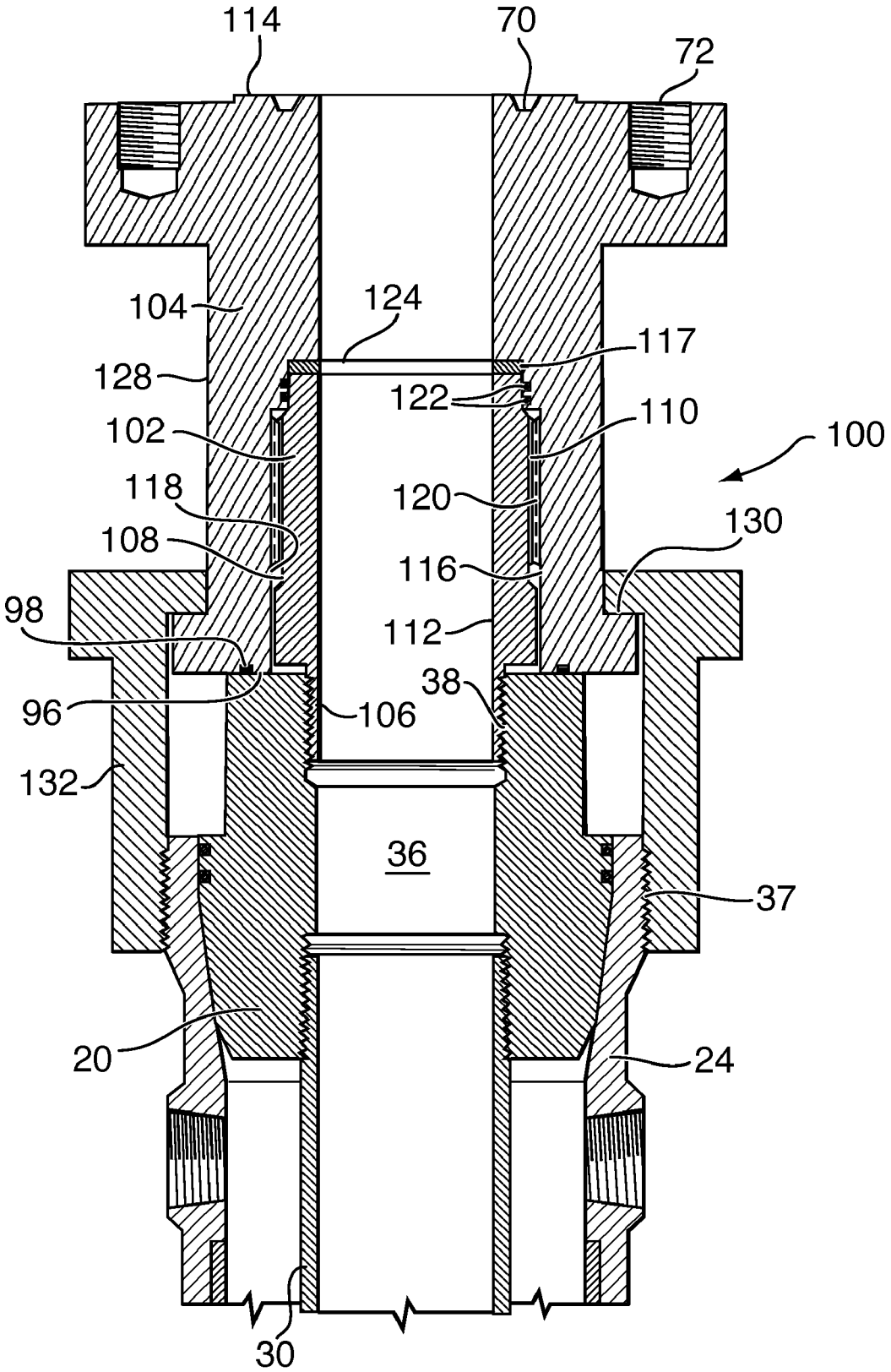
FIG. 6 is a schematic cross-sectional view of a second embodiment of a multi-lock adapter using a third embodiment of the lock down flange for secure connection to the prior art wellhead apparatus shown in FIG. 1.

FIG. 6 is a schematic cross-sectional view of another embodiment of multi-lock adapter 100, which includes a threaded adapter pin 102 and a lockdown flange 104. The threaded adapter pin 102 is configured for threaded connection to the casing mandrel 20 of a Larkin-style independent screwed wellhead, and to the lockdown flange 104. Accordingly, the threaded adapter pin 102 is a cylindrical piece having a bottom end with a pin threaded nipple 106 for engaging the top box threads 38 of the casing mandrel 20, and, at a top end of an exterior wall 108, pin threads 110 for engaging complementary box threads of the lockdown flange 104. An interior wall 112 of the threaded adapter pin 102 provides an extension of the axial passage 36, which is further extended by the lockdown flange 104.

The lockdown flange 104 has a top flange 114 for securing a high pressure valve, blowout preventer, fracstack, or the like (none of which are shown) in fluid communication with the production casing 30. An adapter pin chamber 116 receives the threaded adapter pin 102. The adapter pin chamber 116 has a chamber wall 118. The chamber wall 118 includes box threads 120 complementary with the pin threads 110 on the exterior wall 108 of the threaded adapter pin 102, and annular grooves 122 for receiving O-ring seals.

One of the challenges encountered in the field when working with tools like the multi-lock adapter 100 is the variability among independent screwed wellheads. It is desirable to achieve a fluid-tight connection with as many casing mandrels as possible. Different casing mandrels may have slight differences in a length of the top box threads 38, or in an insertion depth above the top box threads. The threaded adapter pin 102 accommodates such variations by 1) providing a long nipple; and 2) accommodating a pancake gasket of a thickness selected to compensate for variations by providing a fluid seal in an annular gap 124 between a top end 117 of the adapter pin chamber 116 and the annular grooves 122 for retaining the O-ring seals. Any variation in insertion depth is therefore compensated for by a variable thickness of the pancake gasket inserted in the annular gap 124. In this way the same multi-lock adapter 100 can be used on different casing mandrels 20.

The top flanged surface 114 has the same features as the top flanged end 66 of the flanged adapter pin 62 of FIGS. 4 and 5, and the bottom surface is substantially the same as the bottom connection surface 96 of the lockdown flange 80 shown in FIG. 4, so those descriptions are not repeated.

The outer periphery 128 of the lockdown flange 104 includes an annular shoulder 130 for supporting an elongated lockdown nut 132 that permits connection to the independent screwed wellhead 24. The raised profile of the casing mandrel 20 to which the lockdown flange 104 is mounted, vertically separates the bottom surface of the lockdown flange 104 from the independent screwed wellhead 24. This vertical separation is compensated for by the extended length of the lockdown nut 132.

To mount the multi-lock adapter 100 to a Larkin style independent screwed wellhead assembly, the threaded adapter pin 102 is first screwed into the casing mandrel 20. A distance the nipple extends above the top surface of the casing mandrel 20 is measured to determine a height of the annular gap 124, and therefore a thickness of the pancake gasket required. A suitable pancake gasket is selected and placed on a top end of the threaded adapter pin 102. The lockdown flange 104 is then lowered over the threaded adapter pin 102, until the complementary box threads 120 of the lockdown flange 104 contact the pin threads 110 on the exterior wall 108 of the threaded adapter pin 102. The lockdown flange 104 is then rotated to engage the threads until the bottom connection surface 96 of the flanged adapter pin 104 rests against a top of the casing mandrel 20, at which point the pancake gasket is compressed in a sealing operative condition between the top end 117 of the adapter pin chamber 116, and a top end of the threaded adapter pin 102. The lockdown nut 132 is then secured to the exterior periphery 37 of the independent screwed wellhead 24.

Figure 1:
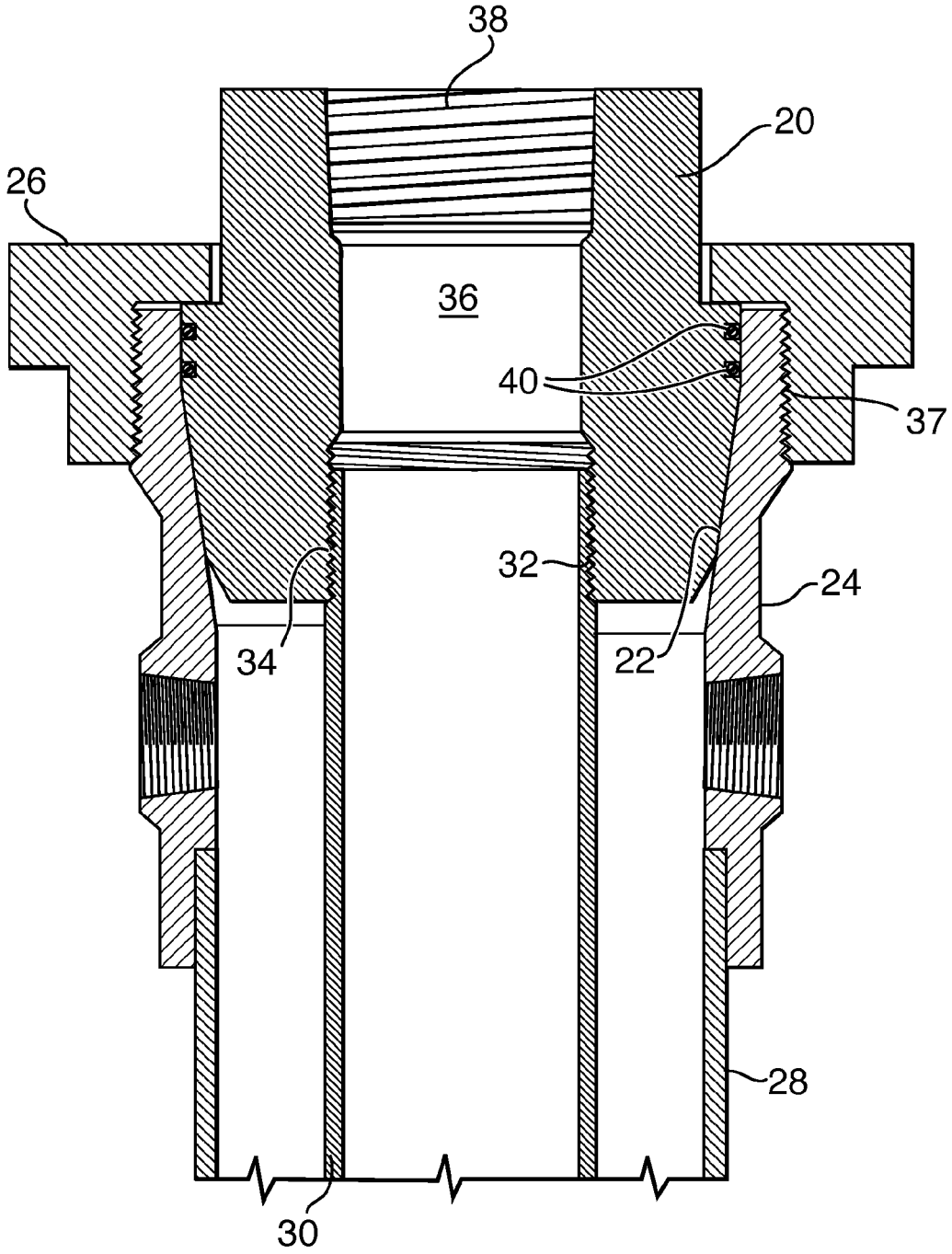
FIG. 1 PRIOR ART
FIG. 1 is a schematic cross-sectional view of a first prior art independent screwed wellhead apparatus.
Figure 2:
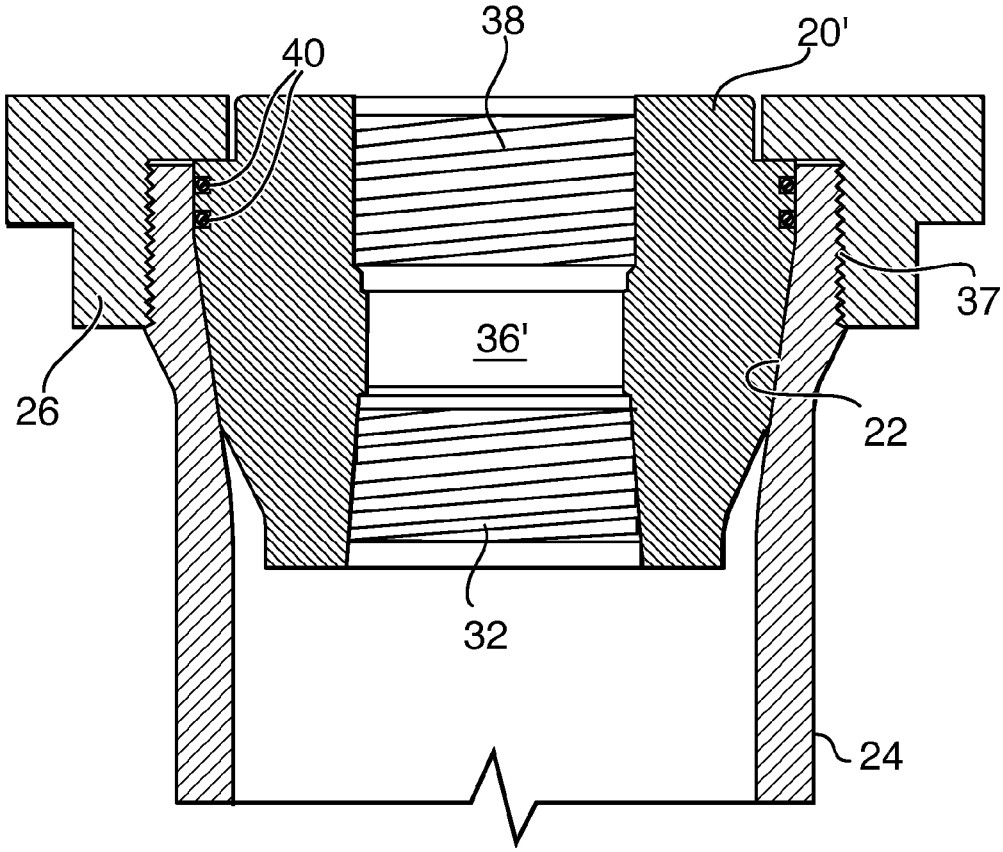
FIG. 2 PRIOR ART
FIG. 2 is a schematic cross-sectional view of a second prior art independent screwed wellhead apparatus.
Figure 3:
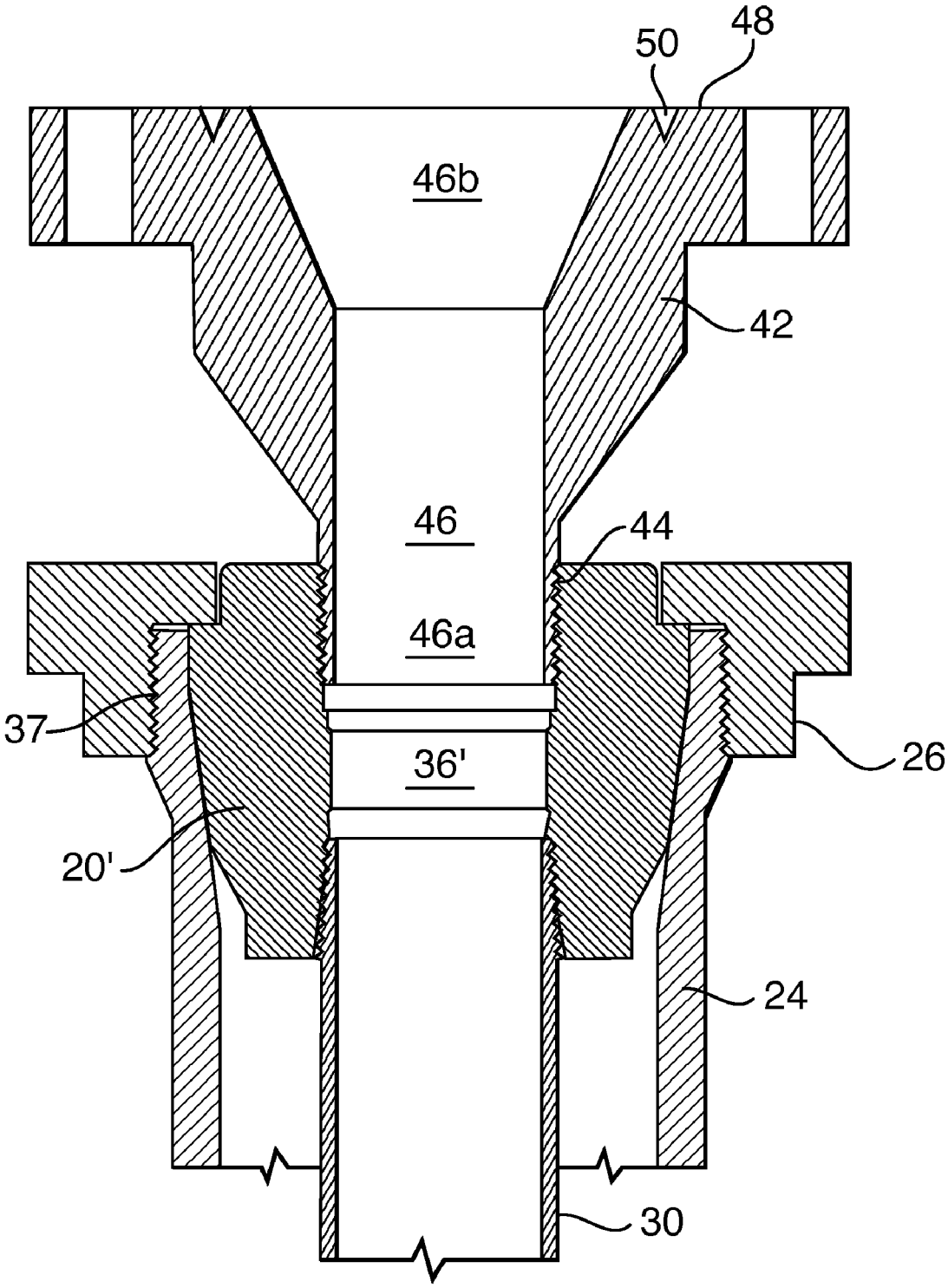
FIG. 3 PRIOR ART
FIG. 3 is a schematic cross-sectional view of the prior art independent screwed wellhead apparatus shown in FIG. 2 connected to a prior art flanged pin adapter.
Figure 7:
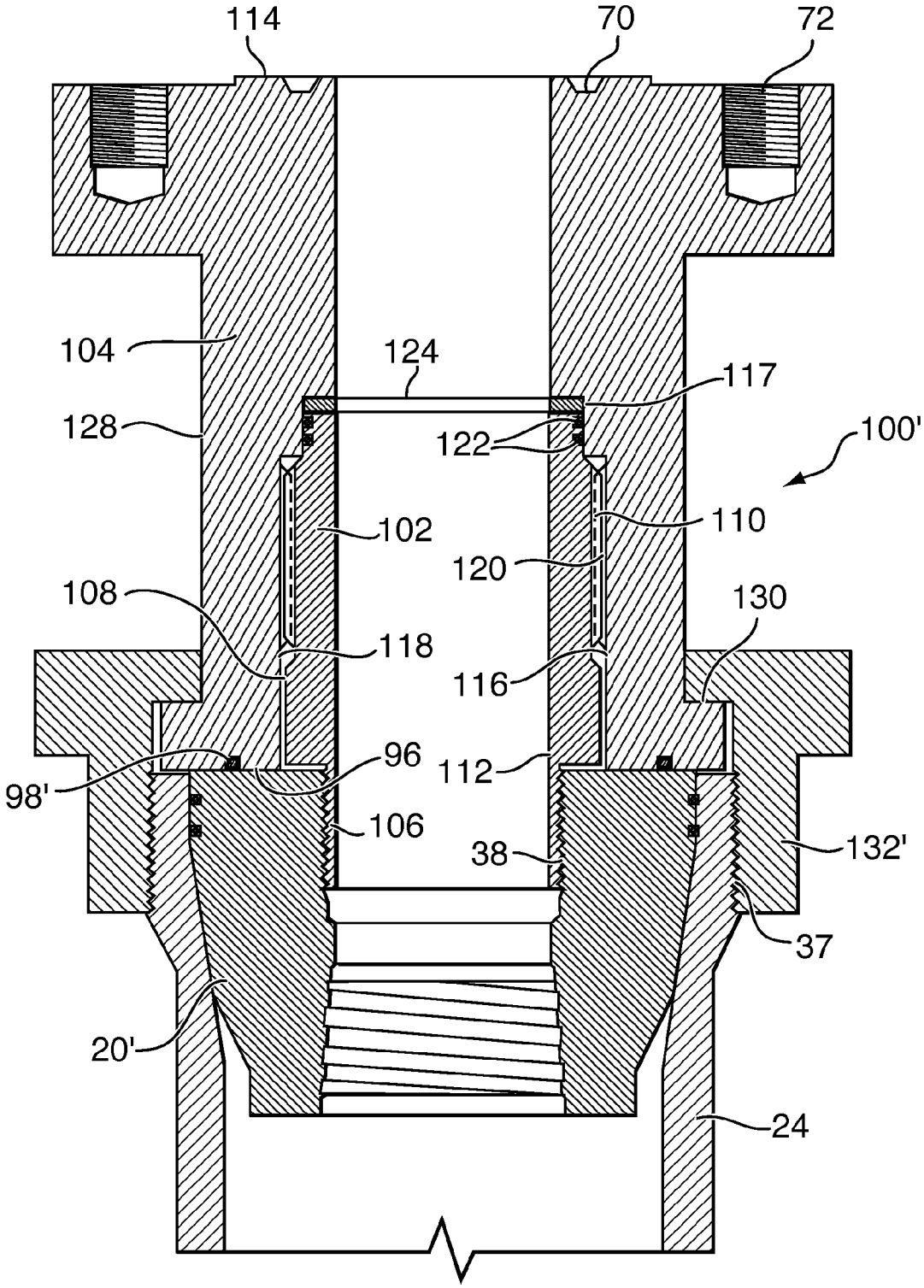
FIG. 7 is a schematic cross-sectional view of the second embodiment of a multi-lock adapter using the third embodiment of the lock down flange for secure connection to the prior art wellhead apparatus shown in FIG. 2.

FIG. 7 is a schematic cross-sectional view of a multi-lock adapter 100' similar to that shown in FIG. 6, except that it is designed for coupling to the casing mandrel 20' of the independently screwed wellhead assembly shown in FIG. 2. Accordingly the extended length of the lockdown nut 132 is not required. Furthermore a flange gasket 98' of the current embodiment is spaced nearer a periphery of the bottom surface 96. It will be recognized that in this manner any of the lockdown flanges of the present invention can be adapted for use with either Larkin-style, or Wellhead Inc. independent screwed wellheads.

Figure 8:
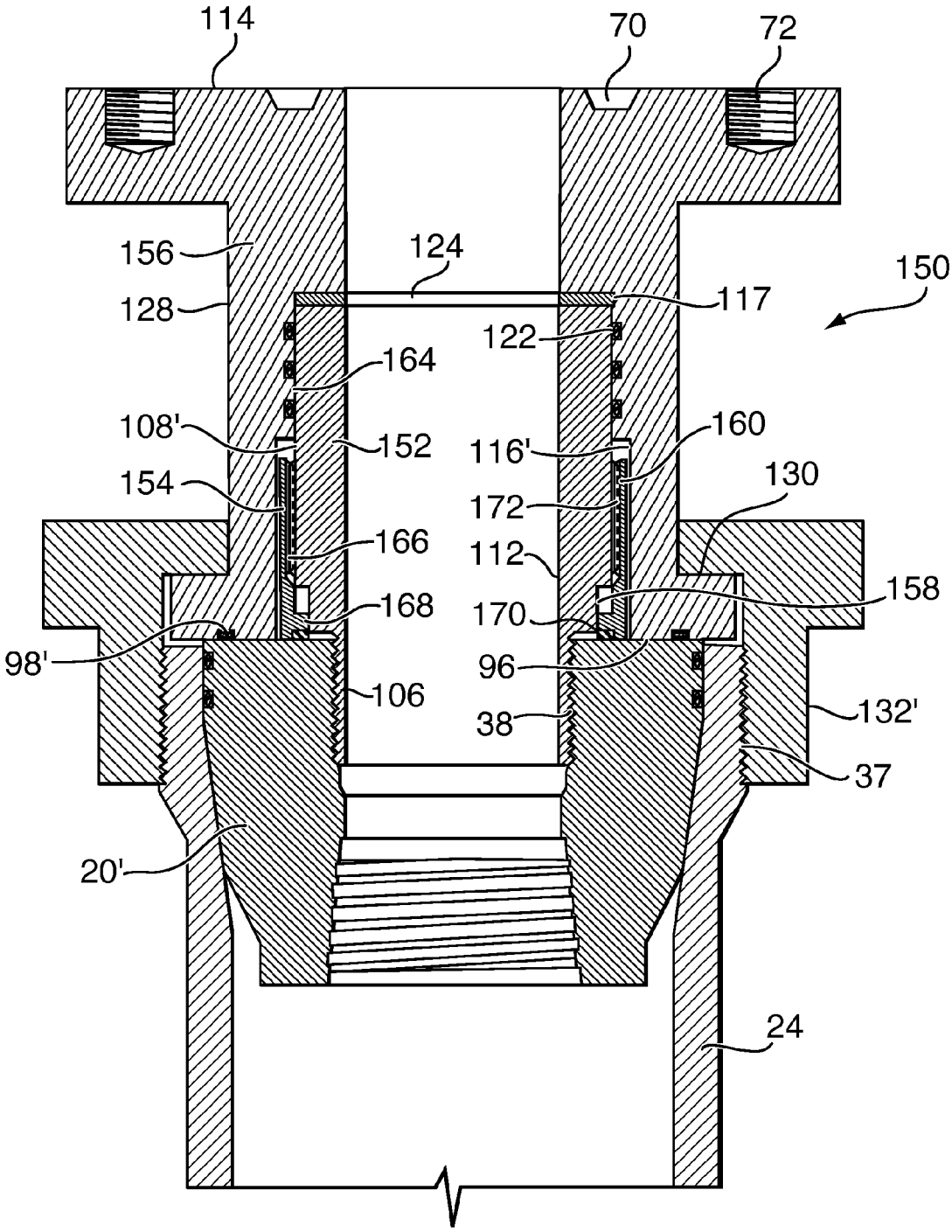
FIG. 8 is a schematic cross-sectional view of a three-piece multi-lock adapter using a fourth embodiment of the lock down flange for secure connection to the prior art wellhead apparatus shown in FIG. 2.

FIG. 8 schematically illustrates a cross-sectional view of a multi-lock adapter 150 having three parts: an adapter pin 152, a pin sleeve 154, and a lockdown flange 156. The adapter pin 152 resembles the adapter pin 102 of FIGS. 6 and 7, except for the exterior wall 108', which, is adapted to couple to the pin sleeve 154, so that the coupled adapter pin 152 and pin sleeve 154 is inserted into an adapter pin chamber 116' of the lockdown flange 156. The exterior wall 108' of the adapter pin 152 is substantially cylindrical, having at a bottom edge, a neck region 158 that forms an annular step at a base of the nipple 106. Above the neck region 158 are adapter pin threads 160 for engaging complementary pin threads of the pin sleeve 154. An upper region of the exterior wall 108' is a smooth cylinder and mates with a top part of the adapter pin chamber 116'.

The lockdown flange 152 resembles the lockdown flange 104 shown in FIG. 6, except that the adapter pin chamber 116' does not include any threads for engaging either the adapter pin 152, or the pin sleeve 154. The adapter pin chamber 116' includes a sealing section 164 above a sleeve chamber 166. The sealing section 164 includes the annular grooves 122 for receiving O-ring seals, or the like, to provide a fluid seal between the adapter pin 152 and the lockdown flange 156. The sleeve chamber 166 has an enlarged radius, and a smooth cylindrical inner wall.

The pin sleeve 154 has an inner surface that cooperates with the lower part of the exterior wall 108' of the adapter pin 152; an outer surface that mates with the smooth cylindrical inner wall of the sealing section 166 of the lockdown flange 156; and a bottom surface for securely meeting a top of the casing mandrel 20'. The inner surface includes an annular step 168 at the bottom that provides an enlarged base for bearing against the top of the casing mandrel 20'. The enlarged base includes an annular groove 170 for receiving a gasket, or the like. The neck region 158 permits the pin sleeve 154 to be coaxially reciprocated with respect to the adapter pin 152.

The advantage of the current embodiment is that if the top box threads 38 of the casing mandrel 20' are of a length that does not permit complete insertion of the adapter pin 152, a position of the pin sleeve 154 is adjusted to provide a secure seating for the adapter pin 152 against the top surface of the casing mandrel. Adjusting of the pin sleeve 154 therefore provides readily apparent benefits for stabilizing the adapter pin 152.

The multi-lock adapter 150 may be mounted to the wellhead 24 by inserting the adapter pin 152 into the pin sleeve 154, and rotating the pin sleeve 154 to move it up above a bottom of the adapter pin 152'. The nipple 106 of the adapter pin 152 is inserted into the top box threads 38 of the casing mandrel 20', and screwed down. The pin sleeve 154 is then lowered and tightened to make secure contact with the top of the casing mandrel 20'. The lockdown flange 156 is then lowered over the adapter pin 152 and pin sleeve 154, and locked into place using the lockdown nut 132'.

Figure 9:
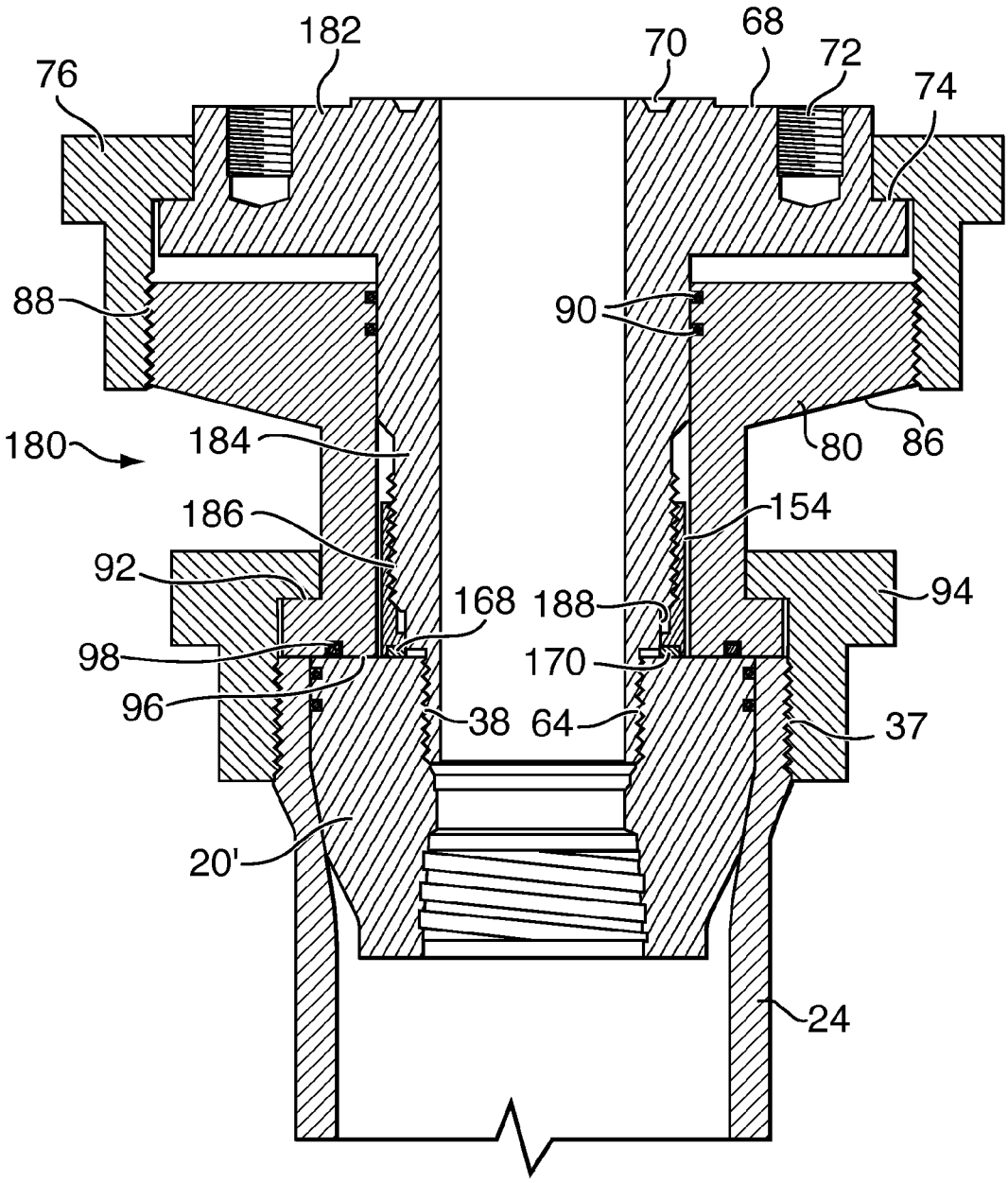
FIG. 9 is a schematic cross-sectional view of a second three-piece multi-lock adapter using the first embodiment of the lock down flange for secure connection to the prior art wellhead apparatus shown in FIG. 2.

FIG. 9 is a schematic cross-sectional view of a multi-lock adapter 180 that is similar to that (60) shown in FIG. 4, but further includes the pin sleeve 154 shown in FIG. 8. The lockdown flange 80, as well as the top flange 68, and bottom end 64 of a flanged adapter pin 182 are the same as corresponding parts of the multi-lock adapter 60 shown in FIG. 4, and their descriptions are not repeated here. An elongated hollow mandrel 184 that forms a midsection of the flanged adapter pin 182 is identical to the elongated hollow mandrel 66 shown in FIG. 4 except for the lower portion of the outer wall of the elongated hollow mandrel 184, which is narrower to provide space for the pin sleeve 154. Adapter pin threads 186 are located above a neck region 188 of like form, arrangement and function as those (160, 158, respectively described above) shown in FIG. 8.

Since the lockdown flange 80 is mounted before the flanged adapter pin 182, in accordance with the current embodiment, it is not possible to install the flanged adapter pin 182, lock down the pin sleeve 154, and then secure the flanged adapter pin 182 to the lockdown flange 80 using top lockdown nut 76. Instead, before mounting the lockdown flange 80, the flanged adapter pin 182 is inserted into the casing mandrel 20' to adjust a position of the pin sleeve 154. The flanged adapter pin 182 with the pin sleeve 154 are then removed by rotating the top flanged end 68. The lockdown flange 80 is mounted to the independent screwed wellhead 24 using the bottom lockdown nut 94, and then the flanged adapter pin 182 is inserted into the lockdown flange 80, and when the pin threads of the nipple engage the top box threads 38 of the casing mandrel 20', the top end of the flanged adapter pin 182 is rotated to threadably connect the flanged adapter pin 182 to the casing mandrel 20'. Because the position of the pin sleeve 154 was previously adjusted when the nipple was inserted into the casing mandrel 20', the bottom end of the adapter sleeve 154 is securely seated against the top surface of the casing mandrel 20'. The flanged adapter pin 182 is then secured to the lockdown flange 80 using the top lockdown nut 76.

Figure 10:
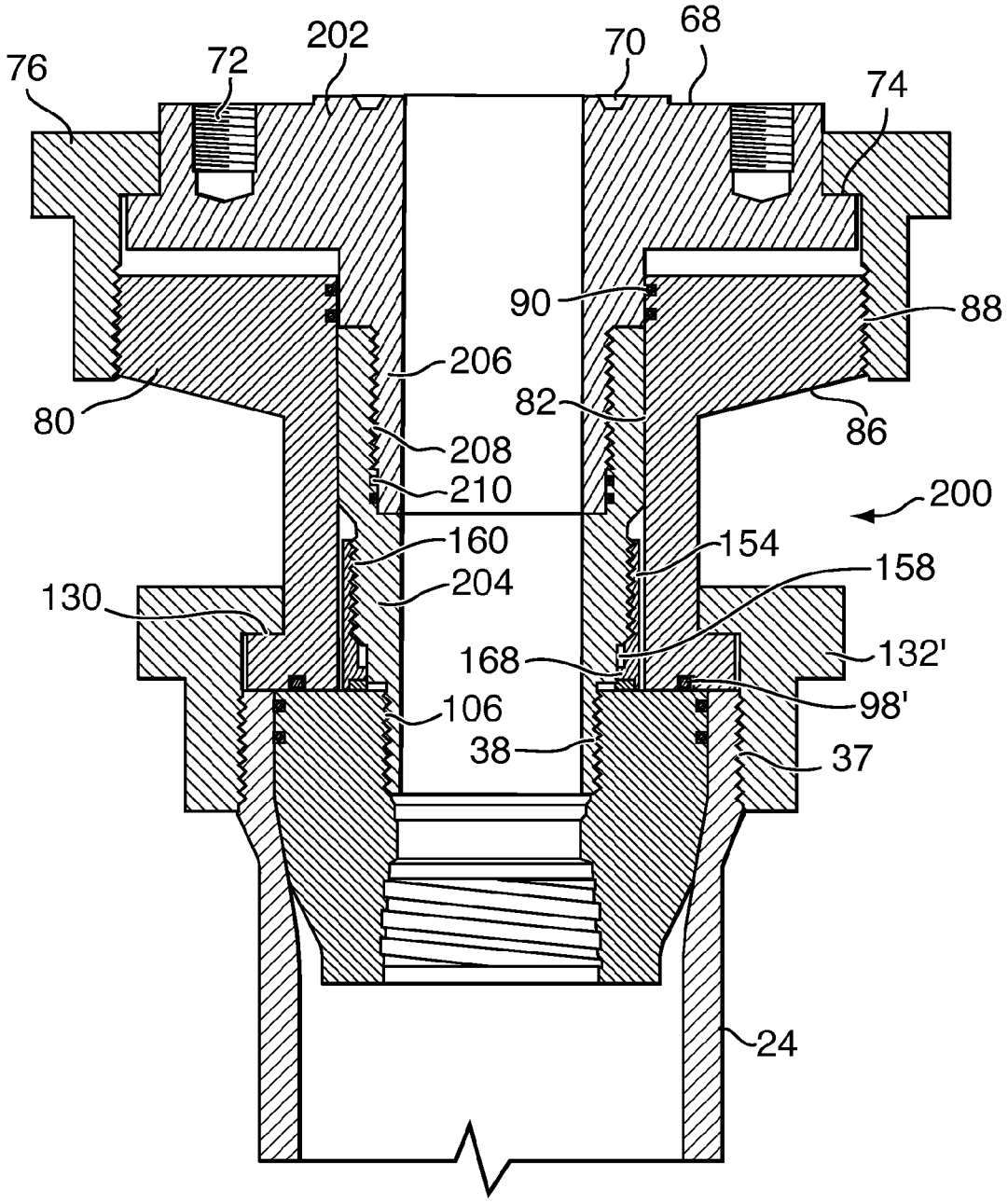
FIG. 10 is a schematic cross-sectional view of a four-piece multi-lock adapter using the first embodiment of the lock down flange for secure connection to the prior art wellhead apparatus shown in FIG. 2.

FIG. 10 schematically illustrates a 4-piece multi-lock adapter 200 in accordance with the invention. The multi-lock adapter includes a flange connector 202, an adapter pin 204, the pin sleeve 154, and the lockdown flange 80. The flange connector 202 provides the top flanged end 68 shown in FIG. 4, including the annular shoulder 74 for supporting top lockdown nut 76, and a mandrel with a pin-threaded nipple 206. An outer wall of the mandrel seals against a top of the interior wall 82 of the lockdown flange 80, which has the annular grooves 90 for receiving O-ring seals.

A lower section of the adapter pin 204 is the same as the adapter pin 152 shown in FIG. 8. The nipple 106 for insertion into the casing mandrel 20', the neck region 158 and the adapter pin threads 160 for engaging the pin sleeve 154 have the same form and function as the corresponding features identified by like reference numerals in FIG. 8. However, a top end of the adapter pin 204 includes a box thread 208, and annular O-ring grooves 210, for permitting fluid-tight connection with the nipple 206 of the flange connector 202.

The advantage of this embodiment is that the adapter pin 204 can be inserted into the casing mandrel 20' and the pin sleeve 154 can be lowered into secure position before the lockdown flange 80 is mounted to the independent screwed wellhead 24. The flange connector 202 is then screwed to the adapter pin 204, and then fastened to the lockdown flange 80 using top lockdown nut 76 to complete the installation.

As will be appreciated by those skilled in the art, the multi-lock adapters of the embodiments described above provide full-bore access to the production casing 30. Consequently, plugs, packers, perforating guns, fishing tools, and any other downhole tool or appliance can be run through these multi-lock adapters. In a multi-zone well this permits a rapid transition from the pumping of high pressure well stimulation fluids and other downhole processes, such as the setting of a wireline plug or packer to isolate a production zone; lubricating in a logging tool to locate a production zone; lubricating in a perforating gun to perforate a casing that runs through a production zone; or performing any downhole operation that requires full-bore access to the production casing 30 without disconnecting the multi-lock adapter or a blowout preventer mounted thereto. Further speed and economy can be achieved by using an apparatus for perforating and stimulating oil wells as described in co-applicant's U.S. Pat. No. 6,491,098, which issued on Dec. 10, 2002, the specification of which is incorporated herein by reference.

The multi-lock adapters shown in the previous embodiments can also be used in conjunction with a blowout preventer protector described in co-applicant's U.S. patent application Ser. No. 09/537,629 filed on Mar. 19, 2000, the specification of which is incorporated herein by reference, to permit a tubing string to be suspended in the well during well stimulation procedures. The tubing string may be used as a dead string to measure downhole pressures during well stimulation, or may be used as a fracturing string to permit well stimulation fluids to be pumped down the tubing string, and optionally down the annulus between the casing and the tubing string simultaneously.

Figure 11:
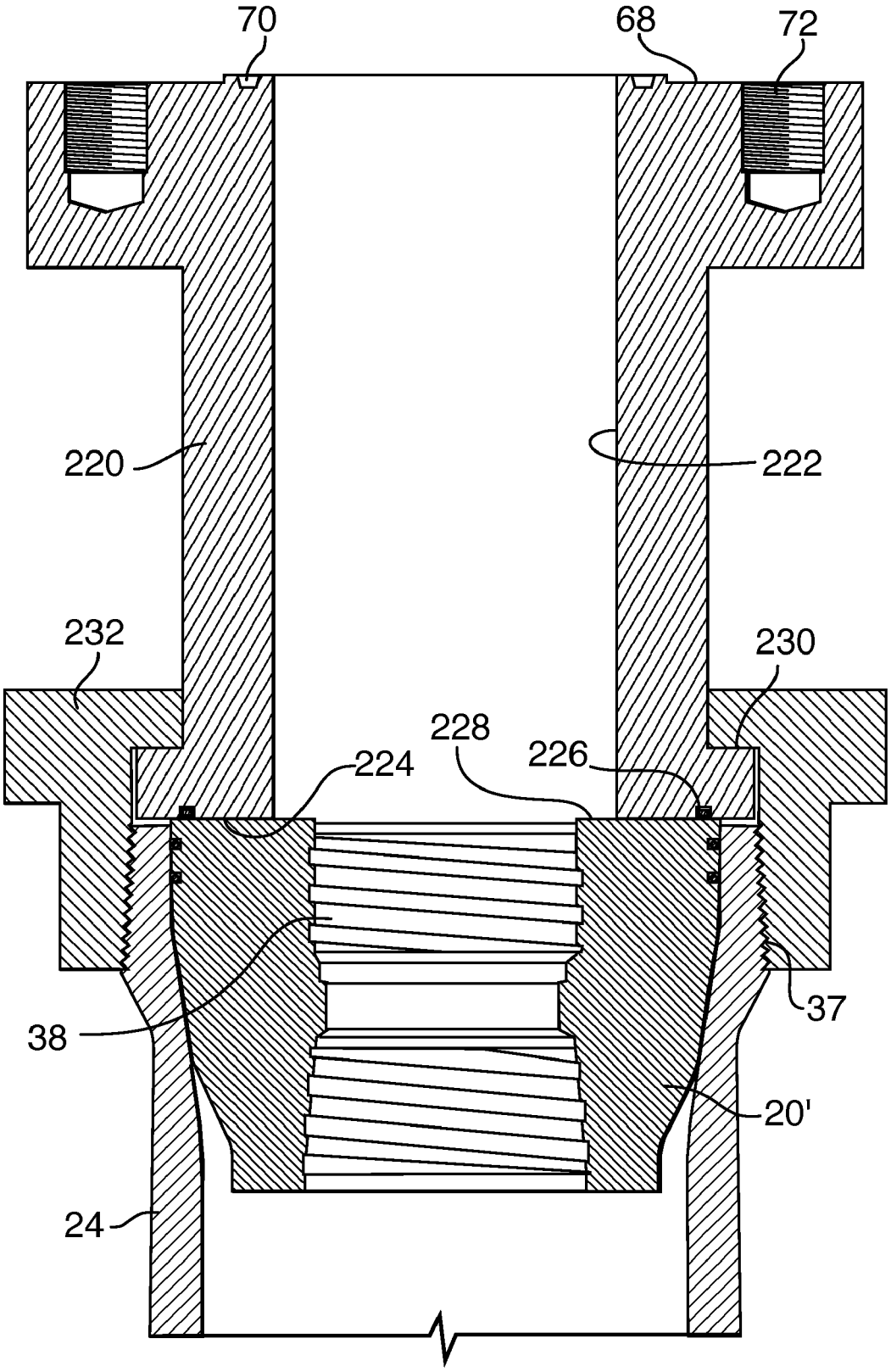
FIG. 11 is a schematic cross-sectional view of a fifth lock down flange for secure connection to the prior art wellhead apparatus shown in FIG. 2.

FIG. 11 schematically illustrates an embodiment of a lockdown flange 220 in accordance with the invention connected to the casing mandrel 20'. The lockdown flange 220 is mounted to a top of the casing mandrel 20'. The lockdown flange 220 includes top flanged end 68 a cylindrical mandrel 222, and a bottom end 224 that includes an annular groove 226 for accommodating a high-pressure fluid seal, such as a flange gasket, well known in the art. The lockdown flange 220 has an internal diameter that is greater than that of the axial passage through the casing mandrel 20' to accommodate a blowout preventer protector described in co-applicant's U.S. Pat. No. 6,364,024, which issued Apr. 2, 2002, the specification of which is incorporated herein by reference. The top flanged end 68 provides a stud pad to which a blowout preventer (not shown) can be mounted. The blowout preventer protector (not shown) may then be mounted to a top of the blowout preventer. A mandrel of the blowout preventer protector is stroked down through the blowout preventer and an annular sealing body on the bottom end of the blowout preventer protector mandrel seals off against an exposed annular portion 228 of a top of the casing mandrel 20', or an inner surface of the mandrel 222. The annular sealing body provides a high pressure seal to ensure that high pressure well stimulation fluids cannot escape through the connection between the lockdown flange 220 and the casing mandrel 20'. The blowout preventer protector provides full-bore access to the well, and permits a tubing string to be suspended in the well during a well stimulation procedure.

The lockdown flange 220 further includes an annular shoulder 230 that supports a lockdown nut 232. The lockdown nut 232 has a box thread that engages the pin thread on the exterior periphery 37 of the casing mandrel 20', to secure the lockdown flange 220 to the casing mandrel 20'. As described in U.S. Pat. No. 6,364,024 the tubing string can be run through the blowout preventer protector into or out of a live well at any time, and if a tubing string is not in the well, any downhole tool can be run into or out of the wellbore.

If stimulation fluids laden with abrasive sand or other proppants are to be pumped into the well during a well stimulation procedure using the blowout preventer protector, the top box thread 38 of the casing mandrel 20' can be protected from erosion using a high pressure fluid seal for sealing against the exposed annular portion 228 as described in co-applicant's U.S. Pat. No. 6,247,537, which issued on Jun. 19, 2001. One embodiment of the high pressure fluid seal provides an inner wall that extends downwardly past the pin thread 38 of the casing mandrel 20' to prevent the pin thread 38 from being "washed out" by the abrasive proppants.

The lubrication of downhole tools into the production casing 76 can also be facilitated by use of a reciprocating lubricator as described in co-applicant's U.S. Pat. No. 6,827,147 which issued on Dec. 7, 2004, the specification of which is likewise incorporated herein by reference.

The embodiments of the invention described above are therefore intended to be exemplary only. The scope of the invention is intended to be limited solely by the scope of the appended claims.

We claim:

1. A multi-lock adapter used to inject fracturing fluid into a cased well equipped with an independent screwed wellhead, the multi-lock adapter comprising:

an adapter pin with a threaded nipple that engages box threads in a central passage of a casing mandrel of the screwed independent wellhead; and a lockdown flange secured to the independent screwed wellhead and connected to the adapter pin, the adapter pin and the lockdown flange providing, in combination, a central passage having an internal diameter at least as large as an internal diameter of a well casing to which the independent screwed wellhead is connected.

2. The multi-lock adapter as claimed in claim 1 wherein one of the adapter pin and the lockdown flange comprises a top flange adapted to support well servicing equipment.

3. A multi-lock adapter used to pump high pressure stimulation fluids into a casing of a well equipped with an independent screwed wellhead, comprising:

a lockdown flange having an axial passage with an internal diameter at least as large as an internal diameter of the casing and an external shoulder that rotatably supports a lockdown nut adapted to engage pin threads on a top end of the independent screwed wellhead;

an adapter pin adapted to be threadedly coupled to a top box thread of a casing mandrel supported by the independent screwed wellhead, the adapter pin having an axial passage with an internal diameter at least as large as the internal diameter of the casing; and a connection between the lockdown flange and the adapter pin that reinforces the threaded coupling between the casing mandrel and the adapter pin.

4. The multi-lock adapter as claimed in claim 3 further comprising a pin sleeve connected to a bottom end of the adapter pin, the pin sleeve being movable into contact with a top surface of the casing mandrel to stabilize the adapter pin.

5. The multi-lock adapter as claimed in claim 3 further comprising a chamber in the axial passage of the lockdown flange that receives the adapter pin.

6. The multi-lock adapter as claimed in claim 5 further comprising a pancake gasket that provides a fluid seal in an annular gap between a top of the chamber and a top of the adapter pin.

7. The multi-lock adapter as claimed in claim 5 wherein the connection comprises pin threads on an exterior of the adapter pin that engage box threads on an interior of the chamber.

8. The multi-lock adapter as claimed in claim 3 wherein the lockdown flange comprises a top flange having pin threads engaged by a lockdown nut rotatably supported by the adapter pin.

9. The multi-lock adapter as claimed in claim 8 wherein the adapter pin further comprises a top flange that provides a stud pad.

10. The multi-lock adapter as claimed in claim 9 wherein the adapter pin further comprises a mandrel that extends through the axial passage of the lockdown flange.

11. The multi-lock adapter as claimed in claim 10 wherein the adapter pin lockdown nut is supported by an annular shoulder formed on an outer wall of the mandrel.

12. The multi-lock adapter as claimed in claim 10 wherein the adapter pin lockdown nut is supported by an annular shoulder on a periphery of the stud pad.

13. The multi-lock adapter as claimed in claim 11 wherein an interior wall of the lockdown flange comprises annular grooves for supporting fluid seals to inhibit a passage of fluid between the lockdown flange and the outer wall of the mandrel.

14. The multi-lock adapter as claimed in claim 12 wherein the adapter pin further comprises a pin sleeve connected to a bottom end of the adapter pin, the pin sleeve being movable into contact with the top of the casing mandrel.

15. The multi-lock adapter as claimed in claim 10 wherein the adapter pin comprises two separable pieces, an adapter pin comprising a threaded nipple that threadedly couples to the top box thread of the casing mandrel, and a flanged coupler, the two pieces being connected together.

16. A multi-lock adapter for an independent screwed wellhead, comprising:

an adapter pin that engages top box threads in a central passage of a casing mandrel of the wellhead;

a lockdown flange connected to the adapter pin; and a lockdown nut for securing the lockdown flange to the independent screwed wellhead, the adapter pin and the lockdown flange providing, in combination, a central passage having an internal diameter at least as large as an internal diameter of a well casing to which the independent screwed wellhead is connected.

17. The multi-lock adapter as claimed in claim 16 wherein the lockdown flange is connected to the adapter pin by a top lockdown nut that engages a pin thread on a top flange of the lockdown flange.

18. The multi-lock adapter as claimed in claim 17 wherein the lockdown nut is rotatably supported by an annular shoulder on an outer periphery of a mandrel of the adapter pin.

19. The multi-lock adapter as claimed in claim 17 wherein the lockdown flange comprises a chamber in an axial passage of the lockdown flange that receives the adapter pin.

20. The multi-lock adapter as claimed in claim 19 further comprising a pin sleeve that engages threads on an outer periphery of the adapter pin, and the pin sleeve is movable to seat against a top surface of the casing mandrel.

* * * * *